United States Patent [19]

Potter

[11] 3,967,067

[45] June 29, 1976

[54] SECRET TELEPHONY

[75] Inventor: Ralph K. Potter, Madison, N.J.

[73] Assignee: Bell Telephone Laboratories, Incorporated, Murray Hill, N.J.

[22] Filed: Sept. 24, 1941

[21] Appl. No.: 412,056

[52] U.S. Cl. ..... 179/1.5 R; 179/1 SA
[51] Int. Cl.[2] ..... H04K 1/02
[58] Field of Search ..... 179/1.5, 1.5 R, 1 SA

[56] References Cited

UNITED STATES PATENTS

| | | | |
|---|---|---|---|
| 1,310,719 | 7/1919 | Vernam | 178/22 |
| 1,829,783 | 11/1931 | Chestnut et al. | 179/1.5 |
| 2,213,320 | 9/1940 | Mathes et al. | 179/1.5 |
| 2,243,527 | 5/1941 | Dudley | 179/1 SA |

*Primary Examiner*—Howard A. Birmiel
*Attorney, Agent, or Firm*—H. A. Burgess

EXEMPLARY CLAIM

1. In a system of secret transmission of speech, means to subdivide speech waves constituting a message into a plurality of narrow frequency bands, means to integrate the energy in each band, means individual to said bands to subdivide the integrated energy from each band on a time basis to produce impulses with intervening spaces, and means to variably control said last-mentioned subdividing means individually in accordance with a key unrelated to the message.

18 Claims, 8 Drawing Figures

INVENTOR
R. K. POTTER
BY
H. A. Burgess
ATTORNEY

INVENTOR
R.K.POTTER
BY
H. A. Burgess
ATTORNEY

INVENTOR
R.K.POTTER
BY
H.A.Burgess
ATTORNEY

SECRET TELEPHONY

The present invention relates to the transmission of messages with privacy or secrecy.

The general object of the invention is to transmit speech with a high degree of privacy, although the invention is capable of extension to other types of waves than speech waves.

The invention makes possible the secret transmission of speech in accordance with a frequently or continuously changing code. In order to restore the intelligibility at a receiving point, one must be in possession of the code. Knowledge of the character of the apparatus used or of the nature of the scheme that is employed for destroying the intelligibility is not sufficient to enable the message to be received and understood.

The invention in the form of embodiment specifically disclosed herein, utilizes the general method of ciphering and deciphering that is disclosed in Vernam U.S. Pat. No. 1,310,719, July 22, 1919, as applied to telegraph transmission, but applies such method to the ciphering and deciphering of speech.

For certain types of speech transmission, speech quality or naturalness is relatively unimportant so long as the information is transmitted and received with a high degree of privacy. In such cases transmission of the approximate wave form of the speech suffices. It has been found that speech waves can be analyzed by means known in the art into slowly varying currents in a number of separate circuits, each such current varying at roughly syllabic rate, a working value of which is taken as zero to 25 cycles per second, and that the process can be reversed to give understandable speech. One prior art disclosure of this is given in Dudley U.S. Pat. No. 2,151,091, Mar. 21, 1939.

It has been found that the wave form of these slowly varying currents can be varied considerably without destroying the intelligibility of the speech that is reformed from them, sufficient informational content in them appearing to be carried by their fundamental or major variations. I have found it practicable to derive understandable speech from these slowly varying currents if no more than an on-off indication with respect to them is transmitted (supplemented by suitable wave shaping which can be done at the receiver), the on-off condition referring not to the absolute current-no-current condition but to some intermediate value of current so that current in excess of this value is taken as the "on" or "current" (marking) condition and current of less amplitude is taken as the "off" or "no-current" (spacing) condition. It is not to be assumed from this, however, that the invention is limited to a particular intermediate value of current as the reference zero nor to some one value as distinguished from a changing value or differently chosen values.

One way of translating these slow current variations into on-off or marking-spacing indications, in accordance with this invention, is by the use of telegraph relays, or equivalent devices, the adjustments being such that the relay is energized by rising current when the amplitude reaches the reference value, remains energized so long as the amplitude exceeds such value and releases by falling current when the amplitude passes the release current value of the relay which can be made nearly the same as the value for energization but is usually slightly smaller. In this manner the slowly varying currents into which the speech has been analyzed in the plurality of separate paths can be translated into marking and spacing indications or pulses of varying length. These pulses are then, in accordance with this invention, ciphered and transmitted by apparatus of the general type disclosed by Vernam.

The nature of the invention and its features and objects will be more fully understood from the following detailed description taken in conjunction with the drawing, in which:

FIG. 1 is a schematic circuit diagram of one form of transmitting circuit according to the invention;

FIG. 2, which should be placed immediately below FIG. 1, is a similar diagram of a receiving circuit according to the invention;

In the type of transmission disclosed in the Dudley patent, the speech waves are subdivided into narrow frequency bands and the waves in each band are rectified or detected and then put through a 0 to 25-cycle low-pass filter. These slowly varying currents are used as speech-defining signals. In order to remake speech from them, waves in similar ranges to those of the original bands are produced and are valved to the output circuit by the speech-defining currents, the amplitude of the waves flowing into the output being proportional to the strength of the speech-defining currents.

Figure 3:
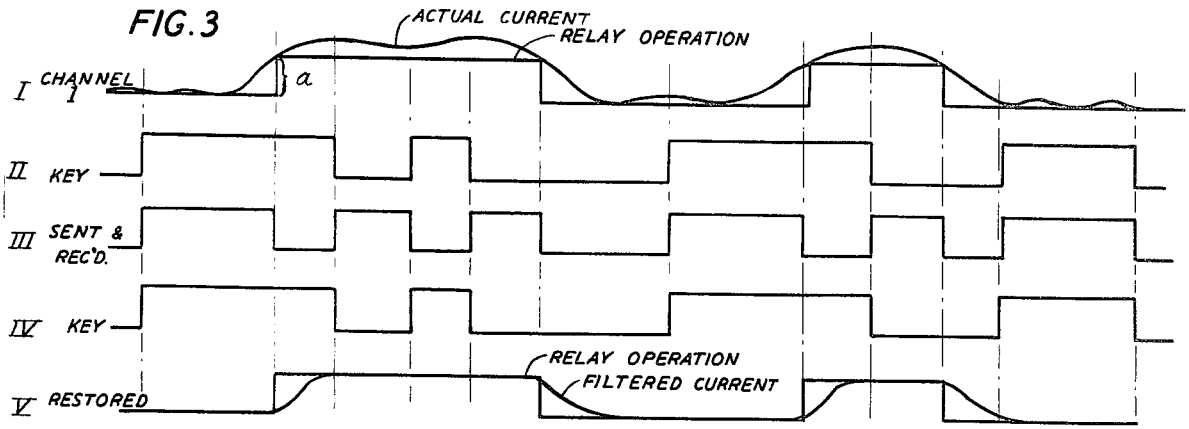
FIG. 3 shows graphs to be referred to in the detailed description.

The character of these speech-defining signals is shown in an oscillogram given in FIG. 10 of a paper entitled "The Carrier Nature of Speech" by H. W. Dudley published in *Bell System Technical Journal*, Volume 19, pages 495 to 515, October 1940. These signals are seen to comprise currents with major variations having durations of the order of a fifth of a second or longer accompanied by minor variations of shorter or longer duration. If some one channel be considered, it is seen that a relay or equivalent device might be set to operate and release at some intermediate amplitude of current and when so operated it could be made to give a fairly close approximation to the major variations occurring in that channel. Such operation has been indicated in FIG. 3 of this application, uppermost curve marked I, where the irregular heavy line represents the actual speech-defining signal in an assumed case by way of example, and the rectangular line shows the direct current that would be obtained from a relay adjusted to be energized and released at the amplitude of current indicated at *a*. By passing such a square wave current through a low-pass filter the corners can be rounded off giving a shape shown in the lowest curve V of FIG. 3, Filtered Current, the resemblance of which is closer to the actual current in curve I. It has been found that the currents obtained in this way by relays can be made sufficiently close to the acutal speechdefining signals to enable understandable speech to be reproduced from such currents. The minor variations are, of course, dropped out by this process with a corresponding loss of information transmitted, but it is found that these contribute mostly to the naturalness or quality of th individual speaker's voice and are not essential to the intelligibility of the transmitted speech. The great advantage of being able to reduce the speech essentially to currents that can be used to actuate relays is that the highly secret method invented by Vernam for use in telegraphy can now be extended to certain types of telephony, as will be presently disclosed.

Figure 1:
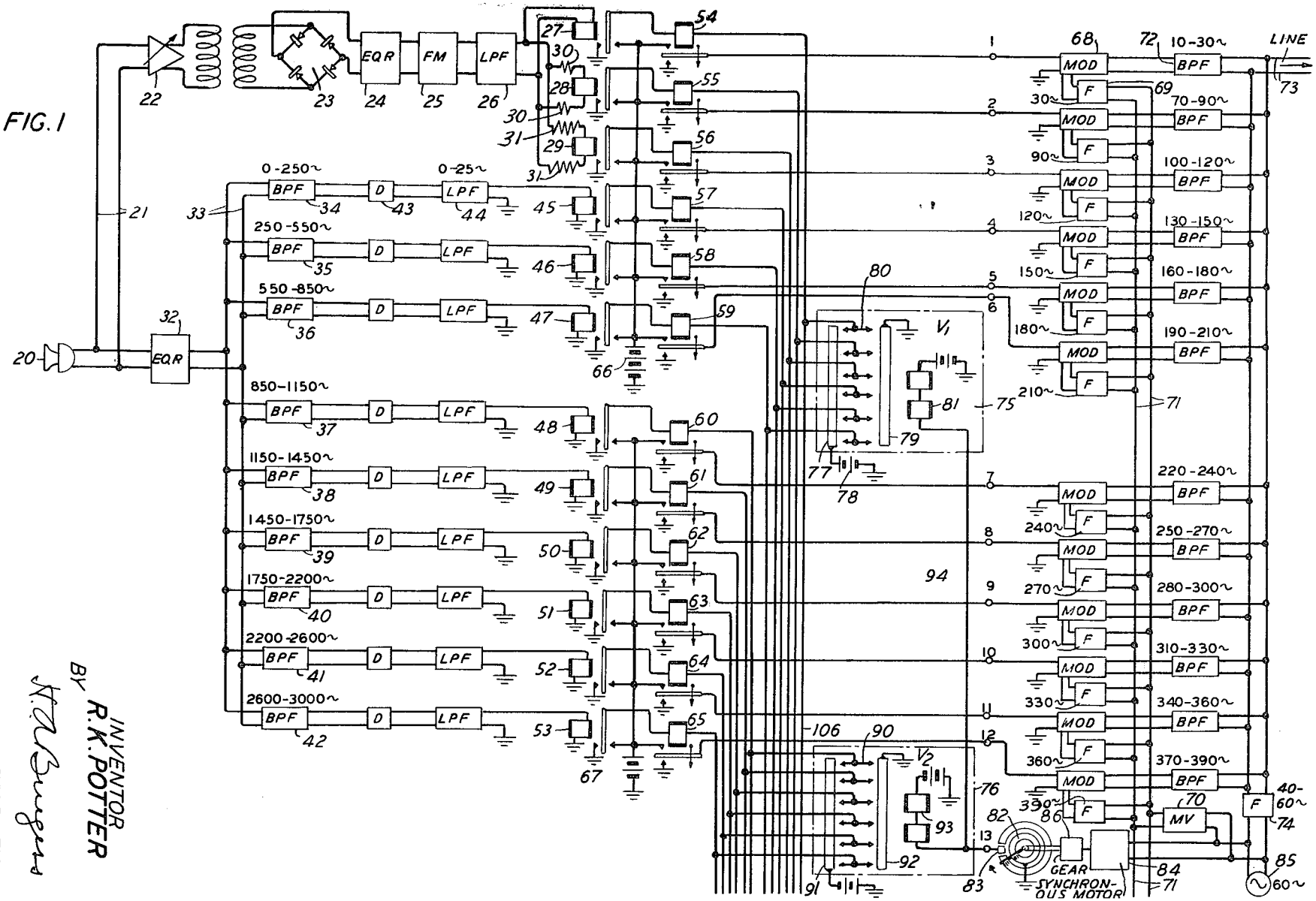

Referring to FIG. 1, a speech input, such as a microphone circuit or other pick-up for converting acoustic waves into electrical waves, is shown at 20. A pitch control circuit 21 leads to the amplifier 22 and to rectifier 23 followed by an equalizer 24, frequency measuring circuit 25 and low-pass filter 26, the purpose of these elements being to derive a slowly varying direct current whose amplitude is proportional to the frequency of the void fundamental. These elements may be of the same type as are more fully disclosed in U.S. Pat. No. to Riesz, 2,183,248, Dec. 12, 1939. The current in the output of filter 26 is normally varying at some low frequency between 0 and 25 cycles per second. This current operates one or more of the three relays, 27, 28, 29 which are given graduated marginal operating characteristics by means of series resistances 30,31 in increasing amounts in the circuits of relays 28 and 29. For a low fundamental frequency relay 27 alone is energized; for a medium fundamental frequency relays 27 and 28 are energized; and for a high fundamental frequency all three relays are energized. The function of these relays will be disclosed more fully at a later point.

The output of speech pick-up 20 also leads through an equalizer 32 to a subdividing circuit 33 connected in common to the band-pass filers 34–42 which have suitable pass ranges for subdividing the total speech band to be transmitted, assumed in this case to be 0 to 3,000 cycles. The band widths are indicated on the various filters, by way of example, there being considerable choice as to the actual band widths used and also as to the number of such subdividing filters. The output of each filter is rectified or detected at 43 and the resulting direct current varying at syllabic frequencies is passed through a low-pass filter 44 and arranged to energize one of the code relays 45–53. It will be understood that each of these relays is operated, in accordance with the description given above in connection with FIG. 3, when the current in the corresponding channel rises to a sufficiently high value and remains operated so long as the current is in excess of such value.

Reference to the oscillogram in the Dudley paper, *Bell System Technical Journal*, referred to above shows that the speech-defining signals are, in general, stronger in the low frequency bands than in the high frequency bands. It is desirable, therefore, to employ different sensitivities in the relay circuits in the different channels. This could be done by adjusting the sensitivities of the different relays or by including different amounts of gain or loss in the individual channels but, in accordance with the present disclosure, the equalizer 32 serves this purpose, its characteristic being sloped over the total frequency band in accordance with the variations in level of the speech-defining signals in the different channels.

Each of the relays 27, 28, 29 and 45–53 has an armature which makes contact with a grounded terminal when the relay is energized and makes contact with a terminal leading to batteries 66 or 67, as the case may be, when the relay is deenergized. Each of these relays is paired with a corresponding transmitting relay 54–65 which is actuated conjointly by one of the code relays 27, 45, etc. and a cipher mechanism 75 or 76 which latter are of the type disclosed in the Vernam patent referred to and shown at D in the Vernam patent. Such cipher device may comprise, by way of example, referring to device 75, a tape-controlled telegraph transmitter having fingers 80 which are selectively actuated in accordance with punchings in a tape so as to be moved either to the left or to the right and to make contact either with a plate 77 connected to battery 88 or to a plate 79 connected to ground. In the Vernam patent the ciphering device had five of these fingers, whereas the present disclosure assumes six, both constructions being known in the art. Two such devices, 75 and 76, are employed in order to accommodate the twelve channels illustrated herein. It is understood that the use of the 12 channels is given by way of example and is not to be construed as limiting since the number may be varied in practice. In the ciphering device 75 there is a stepping magnet 81 which, when energized, advances the tape one step to present a fresh row of holes to the fingeractuating members, it being understood that the key finger combination is determined by the number and arrangement of holes in the tape in any one position. The stepping magnet 81 is operated periodically by a rotating contact maker 82 having a grounded brush which sweeps over the contact 83 once each rotation. Corresponding stepping magnet 93 in cipher device 76 is operated at the same time. it will be noted that in device 76 the fingers are shown at 90, the battery plate at 91 and the ground plate at 92. The frequency of operation of the stepping magnets 81 and 93 may be chosen to secure best operation in any particular case. It is desirable that the devices be operated at a rate at least high enough to correspond to several operations for one operating interval of the relays 27, 28, 29, 45–53.

Assuming any one channel, by way of example such as the channel including filter 34 and relay 45, let it be supposed that this channel is at the moment carrying sufficient current to energize relay 45. Let it also be supposed that the finger 80 with which relay 57 is connected is moved to the left by the key tape. Under these conditions it is seen that relay 57 is energized since the key tape is applying battery to one end of its winding, while relay 45 is applying ground to the opposite end. If an instant later, while relay 45 is still energized, the key calls for a shift in the corresponding finger 80 to move it to the right, it is seen that relay 57 is deenergized since ground is applied to both terminals of its winding. The next key may leave the corresponding finger 80 in the same position or may move it to the left, since the key is assumed to be of random nature. In order to allow for the slight interval during which the key tape is moving from one key combination to the next, the armatures of all of the relays 54– 65 are indicated as slow releasing so that whichever relays have been in the energized condition for one key combination are held energized until the next key combination becomes operated. In the same way that has been described in connection with relays 45 and 57, so in the case of each of the other pairs of relays 27, 54, or 28, 55, etc. the transmitting relay of the pair, such as 54, 55, etc., is either energized or deenergized under the joint control of the code relays 27, 28, etc. and the corresponding ciphering mechanism 75 or 76. Tapes with different keys may be used in the two ciphering devices 75 and 76 or the same key may be used with both devices, as desired.

The effect of the key on the character of the transmitted impulses may be readily seen by adopting the convention of a plus (+) to indicate that any one of the message relays 27, 45, etc. is energized and zero to indicate that such relay is deenergized, and further by using a plus (+) to indicate that the key is applying battery and a (0) to indicate that the key is applying ground. The same convention indicates that relays 54, 55, etc. are energized (+) or deenergized (0). The following table illustrates the relationship:

| | | | | |
|---|---|---|---|---|
| Message | + | + | 0 | 0 |
| Key | + | 0 | + | 0 |
| Transmitted | 0 | + | + | 0 |

In other words, whether the message at the moment is plus (+) or zero (0), the transmitted current may be either plus (+) or zero (0) depending upon the key used. This is further illustrated in FIG. 3 in rows I, II and III. Row III is derived by combining I and II in the manner indicated above. The current that is transmitted is shown by row III and is seen to give no direct clue to the character of the message current.

The impulses produced by the individual armatures of the relays 54–65 may be transmitted to the distant receiving station in any suitable manner, such as any of the known methods of multiplex transmission. The example illustrated in FIG. 1 assumes a multiplex carrier type of transmission, each of the armatures of these relays leading directly to the input of one of the modulators 68 and applying to such modulator either a marking voltage or a spacing (zero) voltage.

These modulators are supplied with carrier frequencies through the individual filters 69 connected in common to the bus-bars 71 which are supplied with the various carrier frequencies from multivibrator 70, this being supplied, in turn, from a suitable source 85 assumed to generate 60-cycle current. The multivibrator 70 delivers frequencies which are multiples of 30 cycles to the various modulators 68, the lowest frequency used being 30 cycles and the highest frequency used being 390 cycles. Assuming that a band 20 cycles wide is sufficient to convey the information required in each channel, the band-pass filters 72 are constructed to pass the lower side-band resulting from each modulator 68, the actual side-bands passed being indicated on each of the filters 72. The outputs of all of these filters are connected in common to the outgoing line 73 which may lead to the distant receiving station directly or to a radio transmitter or any other suitable type of transmission channel or medium. A filter 74 with a pass-band 40 to 60 cycles is shown for transmitting directly to the line a portion of the 60-cycle wave from generator 85 for synchronizing the receiver with the transmitter. The contact maker 82 is shown driven by synchronous motor 84 energized from source 85, the drive for the contact maker including reduction gearing 86.

Figure 2:
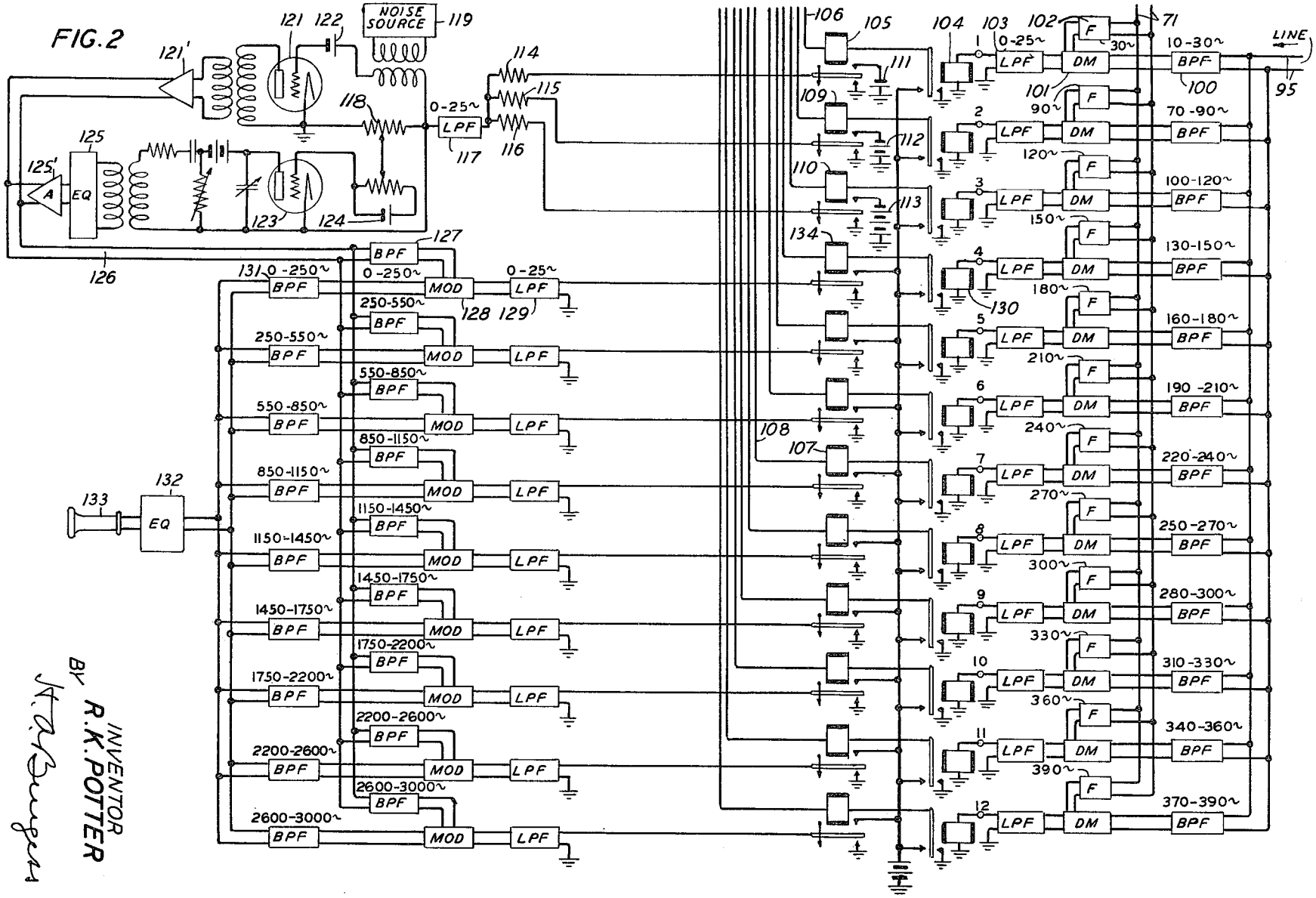

The manner in which the waves from the station of FIG. 1 are received and translated into understandable speech at the distant receiving station may be understood by considering that waves of similar nature are being received from such distant station, like FIG. 1, over the line 95 at the station comprising FIGS. 1 and 2. Lines 73 and 95 may be the eastward and westward sides of a four-wire circuit of any type or they may be connected to the conjugate branches of the usual hybrid coil, in which case the transmitting and receiving circuits at the same station are connected via the hybrid coil to a two-wire line as in common practice.

The various side-bands received over the line 95 are separated by the band filters 100 which have the same passbands as the corresponding filters 72. The band filters 100 lead to demodulators 101 each of which is supplied through an individual filter 102 with the proper carrier frequency from bus-bars 71 to demodulate the corresponding signals. The demodulated current is put through low-pass filter 103, which may reduce to a shunt capacity in some cases, to smooth the current. Each low-pass filter 103 leads to a corresponding receiving relay 104, etc. which, in turn, conjointly with the ciphering device 75 or 76 determines the operation of a receiving translating relay 105, 109, etc.

The three uppermost relays 105, 109, 110 are in the fundamental pitch channel and cooperate with the relays 27, 28, 29 of the distant station similar to FIG. 1. If it be assumed that at a particular instant relay 27 at the distant station is energized and relay 54 thereat is also energized by battery on corresponding finger 80 of ciphering device 75 thereat, a marking impulse is transmitted through the corresponding carrier channel causing operation of relay 104 which applies ground to relay 105. Since the other terminal of the winding is receiving battery over conductor 106 from corresponding finger 80 of FIG. 1, relay 105 is energized and applies a relatively low voltage from battery 111 through resistance 114, low-pass filter 117, resistance 118 to ground. Similarly, if relay 28 along with relay 27 of the distant station similar to FIG. 1 is assumed energized, relay 109 along with relay 105 in FIG. 2 is energized and if all three relays 27, 28 and 29 of the distant station are energized, relays 105, 109 and 110 are energized. This is true regardless of what the character of the key may be. For example, in the case of relay 27 at the distant station being assumed energized, if relay 54 at that station is alternately energized and released a number of times while relay 27 remains energized, relay 105 remains energized since the conductor 106 leading to the ciphering device 75 will under the assumed conditions have battery and ground alternately applied to it, and relay 104, operating under control of distant relay 54, will apply ground or battery to the opposite terminal of relay 105 in the proper sequence to maintain relay 105 operated, the key tapes at the two stations being identical. For example, suppose relay 54 of the distant station is deenergized by the grounding of corresponding finger 80. Relay 104 then becomes deenergized applying battery to relay 105, whose opposite conductor 106 is receiving ground from corresponding finger 80. If distant relay 54 is energized, relay 104 is energized and relay 105 is, therefore, energized. Similarly, relay 134 is energized whenever and as long as relay 45 is energized; relay 107 is energized when relay 48 is energized, etc.

The effect of relays 105, 109 and 110 in controlling the fundamental pitch will now be described. In accordance with the Dudley patent disclosure, the speech is reconstructed at the receiving point by the use of a continuous spectrum wave (hiss) and a wave comprising a fundamental and rich in harmonics (buzz). In the present disclosure the hiss or continuous spectrum is furnished by a resistance noise or gas tube source 119 which may be of the type more fully disclosed in the Riesz patent, and the buzz or vocal-cord type wave is generated in a relaxation oscillator 123 also more fully disclosed in the Riesz patent. If no fundamental component is being received, the continuous spectrum energy is transmitted by amplifier 121 and amplifier 121' into the supply circuit 126, the bias battery 122 being of the right value to permit this. Under these conditions the relaxation oscillator 123 is biased beyond cut-off by the bias source 124 so that no oscillations are generated. When a fundamental voice component is received and any one of the relays 105, 109 or 110 is operated, corresponding voltage from source 111 or 112 or 113 is supplied through the high resistances 114 or 115 or 116 and filter 117 across potentiometer resistance 118 as previously noted. The magnitude and polarity are such that when a voice fundamental current is received, amplifier 121 is rendered non-conducting by application of a large negative voltage to its grid and relaxation oscillator 123 is rendered operative to produce a tone the fundamental frequency of which is dependent upon the voltage applied to it from resistance 118. Assuming as in the Riesz disclosure that the direct current in the output of filter of the distant station corresponding to 26 in the pitch control channel of FIG. 1 is proportional to the fundamental frequency, the fundamental tone produced by relaxation oscillator 123 is likewise proportional to the current in resistance 118. This fundamental tone together with its wide range of harmonics is passed through an equalizer 125 and amplifier 125' and is led into the supply circuit 126. It is seen, therefore, that whether the continuous spectrum noise or the vocal-cord type of sounds is being produced, either is supplied over conductor 126 to the various filters 127 leading to the reconstructing modulators 128.

The manner in which the speech is reconstructed is disclosed in the Dudley or Riesz patent. When the speechdefining signals are applied to one or more of the modulators 128 through low-pass filters 129 by operation of the corresponding receiving translating relays 134, etc., these modulators transmit through to the eventual receiver 133 the corresponding proportion of the locally supplied energy (hiss or buzz) that is being supplied to these modulators through the various selective filters 127. The output waves from the modulators are passed through selective filters 131, the outputs of which are connected in common through equalizer 132 to receiver 133. Equalizer 132 may have a characteristic complementary to that of equalizer 32 of FIG. 1.

Referring again to FIG. 3, the impulses as sent and received are shown in row III. Since the key used at the receiver is the same as that at the transmitter, row IV is a duplicate of row II. Combining the received impulses with the key yields directly the square-shaped wave of row V, the square wave corresponding to the relay operation in the case of each of the relays 105, 109, 134, etc. The effect of the low-pass filter 117, 129, etc. is to round off the wave to the form shown by the filtered current curve as has previously been described.

Figure 4:
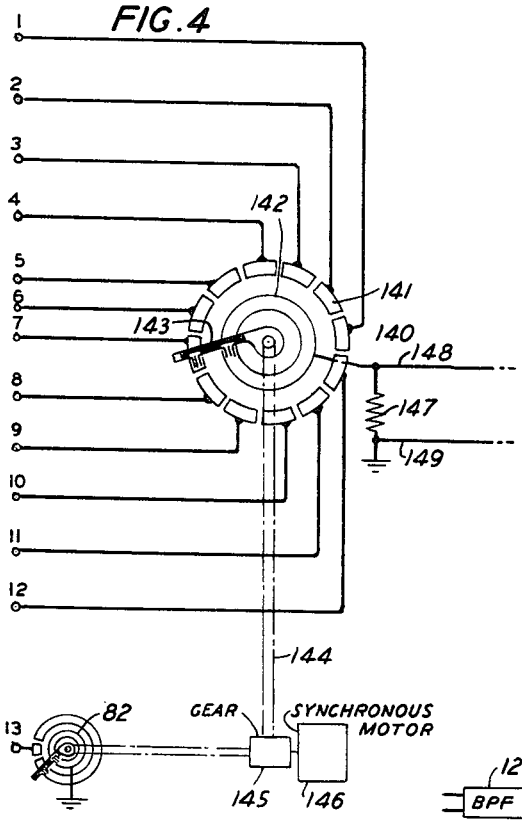
FIG. 4 shows a circuit modification which may be substituted for a portion OF FIG. 1 or a portion of FIG. 2 to the right of the numbered terminals 1–12.

The foregoing description of FIGS. 1 and 2 assumes that the coded impulses are sent on a multiplex carrier basis. FIG. 4 indicates another multiplexing device which may be used if desired. This comprises a rotary distributor 140 for each transmitting circuit and for each receiving circuit, comprising an outer ring of twelve segments 141 and an inner continuous ring 142 with a bridging brush 143. The twelve conductors connected individually to the twelve segments lead to terminals 1–12 which correspond to the similarly numbered terminals in FIGS. 1 and 2. It is assumed that the conductors in FIGS. 1 and 2 are severed at these terminals and that apparatus like that of FIG. 4 is substituted for the apparatus shown to the right of these terminals in each of FIGS. 1 and 2. The rotary distributor is driven by shaft 144 leading to gear-box 145 which is, in turn, driven by motor 146. The contact maker 82 may be driven through suitable gearing from the same motor, the contact 13 representing the point of connection when the rotary distributor is substituted in FIG. 1.

The rotary distributor is connected to the line conductors 148 and 149 by means of coupling resistance 147, one terminal of which is connected to ground which furnishes a return for the circuit connected to the armatures of the various transmitting relays 54–54 or in the case of the receiving station the various receiving relays 104, etc.

It will be necessary to synchronize the movements of the rotary distributors at the transmitting and receiving stations. Various means such as are known in the art may be used for this purpose. These distributors should make several or at least two revolutions in a time corresponding to one marking or spacing interval of the current in FIG. 3, row III.

Figure 5:
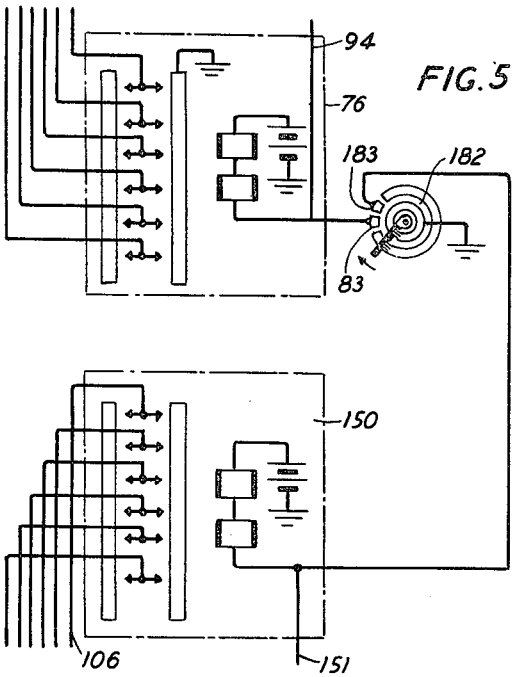
FIG. 5 is a fragmentary view illustrating a modification of the circuits of the ciphering devices of FIG. 1.

In the system disclosed in FIGS. 1 and 2 it is assumed that the transmission time between the terminal stations is sufficiently short to permit the use of the same ciphering devices for both transmitting and receiving. If this is not the case, an arrangement as disclosed in FIG. 5 may be used. In this figure separate ciphering devices are used in the transmitting and receiving circuits of the station shown in FIGS. 1 and 2. Only one such transmitting ciphering device 76 is shown, the conductor 94 leading to the other ciphering device 75 not shown. Similarly, one ciphering device 150 is shown for the receiver with conductor 151 leading to the second such device. In this case the rotary contact maker 182 corresponding to contact maker 82 of FIG. 1, is provided with two displaced segments 83 and 183, whereby the transmitting cipher devices 75 and 76 are energized slightly ahead of the receiving ciphering devices 150, etc. At the distant cooperating station ciphering devices may be used in common for transmitting and receiving as shown in FIGS. 1 and 2, the correction for phase difference due to transmission time being made entirely at one station constructed in accordance with FIG. 5 arrangement. The angular distance between segments 83 and 183 must be made suitable to secure the correct phase relation.

Figure 6:
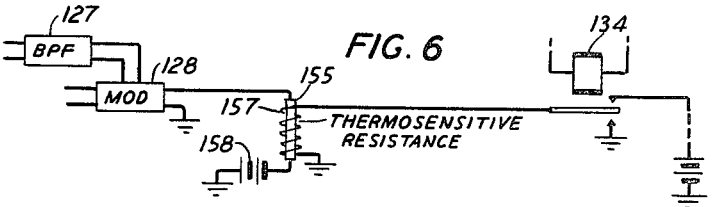
FIG. 6 is a fragmentary diagram showing a modification that may be made in the receiving code channels.

An alternative means that may be used to convert square impulses into rounded impulses is illustrated in FIG. 6. This comprises a thermosensitive element and circuit to be substituted in lieu of the low-pass filters, for example, the lowpass filter 129 in the receiving low frequency channels of FIG. 2 or elsewhere in the system as may be desired.

Figure 7:
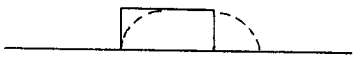
FIG. 7 is a graph illustrating the operation of the circuit of FIG. 6 or 6A.

FIG. 6 discloses the location of the device between one of the translating relays 134 and the modulator 128, that is, in place of the low-pass filter 129. The action of the device is to convert square-cornered impulses of the type illustrated in FIG. 7 into rounded impulses indicated roughly by the dotted line. The square-cornered impulses are produced by movements of the armature of relay 134 and the resulting rounded impulses are applied to the input of the modulator 128.

The device 155 itself may take on any one of several forms but includes a thermosensitive element such as boron, silver sulphide or other substance provided with a heating winding 157 as diagrammatically shown. When the relay 134 attracts its armature and connects battery to the heater winding the temperature of the element 155 is raised, lowering its resistance and permitting current to flow into the input of the modulator 128 from the battery 158. The normal resistance of the element 155 is so high that substantially no current flows through it after it has reached steady state condition with no current in the heating winding 157. When the armature of relay 134 breaks its front contact, the element 155 is not immediately restored to its maximum resistance condition but the cooling can be made to take place gradually according to a desired rate to give the required amount of rounding of the current impulses. This may be done by controlling the shape and dimensions of the element itself and of the winding 157 and by controlling the rate of heat dissipation as by providing some heat insulation where necessary. Elements suitable for this purpose and the construction of the elements of the heating windings and of the means for controlling the heat dissipation are disclosed in one or more of the following U.S. Pat.: Andre et al No. 1,788,970, Jan. 13, 1931; Spray, No. 1,631,836, June 7, 1927; Grondahl No. 1,741,231, Dec. 21, 1929; and Black No. 2,160,823, June 6, 1939.

Figure 6A:
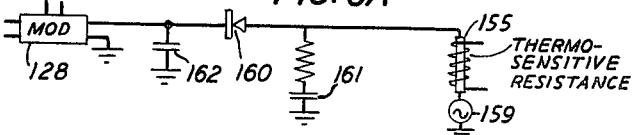
FIG. 6A shows a modification of a portion of FIG. 6.

When silver sulphide is used it is better not to pass direct current through it but a source of alternating current may be used as in FIG. 6A, the source being shown at 159. In this case a rectifier 160 may be used if desired for converting to direct current. Condenser 161 permits alternating current to flow through the element and condenser 162 may be used for smoothing the rectified impulses.

The invention is not to be construed as limited to the specific disclosure but its scope is defined in the claims, which follow.

What is claimed is:

1. In a system of secret transmission of speech, means to subdivide speech waves constituting a message into a plurality of narrow frequency bands, means to integrate the energy in each band, means individual to said bands to subdivide the integrated energy from each band on a time basis to produce impulses with intervening spaces, and means to variably control said last-mentioned subdividing means individually in accordance with a key unrelated to the message.

2. The method of secret transmission of speech comprising simultaneously deriving from each of a plurality of frequency regions of speech waves a current which varies in accordance with the variations of energy content in the corresponding frequency region of the speech, interrupting said current to break the current up into impulses of varying length and spacing, variably modifying the length and spacing of said impulses in accordance with a secret key, transmitting said impulses, and receiving and modifying the transmitted impulses in accordance with a duplicate key to restore said currents to recognizable form.

3. The method of secret transmission of speech comprising analyzing speech message waves into a plurality of speech-defining waves representing syllabic rates of energy variation in each of a plurality of different frequency regions of the speech waves, translating said speechdefining waves into marking impulses and spaces, reconstructing marking and spacing signals therefrom varying in length and spacing in accordance with a prearranged scheme unrelated to the message, transmitting said marking and spacing signals, reconstructing speechdefining waves from the transmitted marking and spacing signals by supplying impulses in accordance with the same prearranged scheme, and reconstructing understandable speech from the reconstructed speech-defining waves.

4. In secret telephony, means to derive from the speech to be sent a plurality of relatively low frequency speech-defining signals, means to translate each of said signals into marking and spacing signs, and means to render the transmission of said signs secret comprising means to combine them with a random key composed of marking and spacing signs occurring in fortuitous order.

5. In secret telephony, means to derive from the speech to be sent a plurality of relatively low frequency speech-defining signals of varying amplitude, means to produce from each such signal marking signs corresponding in length to the duration of signal current above a certain amplitude and spacing signs corresponding in length to the duration of absence of signal current above said certain amplitude, and means to render transmission of said signs secret comprising means to combine with them a random key composed of marking and spacing signs occurring in fortuitous order.

6. In secret telephony, means to derive from the speech to be sent a plurality of relatively low frequency speech-defining signals of varying amplitude, means to commutate said signals at irregular instants depending upon their amplitude to produce marking and spacing signs of varying length, and means to commutate said marking and spacing signs at irregular instants in accordance with a key.

7. In secret telephony, a multiplex transmission path, means to send through the separate channels thereof simultaneously marking and spacing signals indicative of the frequency-energy distribution of distinct frequency regions of the speech spectrum, means comprising a key for each channel and means for combining the individual keys with the respective marking and spacing signals of the different channels to render transmission of said signals secret.

8. A system according to claim 7 including at the opposite end of said path a key for each channel which is a duplicate of the respective key at the sending end, means to combine said keys at said opposite end with the secretly sent signals to restore said signals to recognizable form, and means to reconstruct speech from the restored signals.

9. In secret telephony, means to derive from the speech to be sent a plurality of speech-defining signals each indicative of the energy variations with time of a different frequency region of the speech, means to translate each such signal above a certain amplitude into a mark and each such signal below said certain amplitude into a space, an individual key for each signal, consisting of marks and spaces of random occurrence, and means to combine each key with the marks and spaces obtained from an individual one of said signals, to render transmission of the latter marks and spaces secret.

10. In secret telephony, means to derive from the speech to be sent a plurality of speech-defining signals each indicative of the energy variations with time of a different frequency region of the speech, a separate telegraphic relay operated by each such signal, each relay having an armature for opening and closing contacts, a coding mechanism having contacts adapted to be opened and closed in random manner, and transmitting means under the joint control of said relay controlled contacts and the contacts of said coding mechanism.

11. In secret telephony, a speech input, analyzing filters for subdividing the speech band into narrow portions in separate channels, means to integrate the energy passed through each filter, a relay operated by the integrated energy in each channel, tape controlled coding mechanism having circuit controllers equal in number to said relays and sending means jointly controlled by each of said relays and the circuit controllers of said coding mechanism.

12. In secret telephony, means to subdivide the speech frequency band into narrow subbands in separate channels, means to integrate the energy in each channel, means to translate the integrated energy in each channel into signals comprising fixed amplitude current impulses with intervening spaces, telegraph coding mechanism, and transmitting means jointly controlled by said signals and said coding mechanism.

13. A multichannel multiplex transmission system for transmitting marking and spacing signals between a transmitting station and a receiving station over respective channels, telegraphic relays for transmitting said signals, telegraphic relays for receiving said signals, means at the transmitting station to analyze speech waves into low frequency speech-defining currents in a plurality of separate circuits, means to actuate said transmitting relays by said respective speech-defining currents, a speech synthesizer at said receiving station including means generating waves covering the speech frequency range and means to reproduce speech from said waves under control of speech-defining currents, means controlled by said receiving relays for reproducing the speech-defining currents corresponding to those which actuate said transmitting relays, and means to control said speech synthesizer from the reproduced speech-defining currents.

14. A system according to claim 13 including a mechanical coding mechanism at the transmitting station for modifying the action of said transmitting relays to render unauthorized reception of the signals difficult and a cooperating decoding mechanism at the receiving station for modifying the action of the receiving relays in complementary manner to restore the signals.

15. In a secret telephone system, means at a transmitting station to analyze speech waves into a number of low frequency currents in separate circuits, such currents having gradually varying amplitude, means to translate such currents into marking and spacing signals, means to transmit said signals to a distant receiving station, means at the latter station comprising thermoresponsive resistances to translate said marking and spacing signals into currents of gradually varying amplitudes, and means to reconstruct speech waves under control of said last-mentioned currents.

16. In secret telephony, means at a transmitting station to analyze speech waves into relatively low frequency speech-defining currents simultaneously existing in a plurality of circuits, circuit control means responsive to said currents, coding mechanism comprising a punched tape and automatic stepping means therefor, contacts controlled by said tape in permutations and combinations occurring in random manner, transmitting means under the joint control of said coding mechanism and curcuit control means, for transmitting coded signals to a distant receiving station, receiving means thereat, means at said latter station including a decoded mechanism comprising an identically punched tape to that used in transmission and automatic stepping means therefor, means under the joint control of said receiving means and said decoding mechanism for reproducing speech-defining currents similar to those existent at the transmitting station, and means to reproduce speech currents under control of said reproduced speech-defining currents.

17. In a system of secret transmission of speech in which the speech waves are analyzed into low frequency currents in individual circuits representative in relative current strengths of the frequency energy distribution of speech from instant to instant, means also deriving from the speech the voice fundamental frequency and means to translate such derived frequency into a current of varying strength corresponding to variation in such fundamental frequency means to translate different magnitudes of said last current into respective indications in respectively different circuits, means to transmit to a distant receiving point energy variations characteristic of said low frequency currents in each of said individual circuits and of said indications in said different circuits, means at the receiving point to generate waves of a fundamental frequency under control of and corresponding to said respective indications, together with harmonics thereof, and means to control the generated waves in accordance with said low frequency currents in said individual circuits to reconstruct simulations of speech waves in intelligible form.

18. A system according to claim 17, including means to increase the secrecy of transmission comprising means to combine code signals with said low frequency currents and said indications before transmission and means to supply duplicate code signals at the distant receiving point for canceling the effect of the code signals introduced before transmission.

* * * * *